106-18.32 SR
4/28/87 XR 4,661,382

United States Patent [19]
Cooke, Jr.

[11] Patent Number: 4,661,382
[45] Date of Patent: Apr. 28, 1987

[54] METHOD FOR THE PRESERVATION OF WOOD

[76] Inventor: Theodore F. Cooke, Jr., 287 Weed Ave., Stamford, Conn. 06902

[21] Appl. No.: 829,932

[22] Filed: Feb. 18, 1986

[51] Int. Cl.[4] ..... B05D 1/18; B05D 3/00
[52] U.S. Cl. ..... 427/297; 106/18.32; 106/18.35; 427/440; 428/541
[58] Field of Search ..... 427/297, 440; 428/541; 106/18.32, 18.35; 568/706, 709, 716

[56] References Cited

U.S. PATENT DOCUMENTS 3,968,276 7/1976 Allen ..... 427/440 X
4,290,846 9/1981 Muntwyler ..... 427/440 X
4,399,195 8/1983 Allen ..... 427/440 X

*Primary Examiner*—Michael R. Lusignan
*Attorney, Agent, or Firm*—Frank M. Van Riet

[57] ABSTRACT

A method for the preservation of wood is disclosed whereby the wood is treated with an aqueous, alkaline solution of an alkylol group containing phenol.

16 Claims, No Drawings

METHOD FOR THE PRESERVATION OF WOOD

BACKGROUND OF THE DISCLOSURE

The rendering of wood less susceptible to fungal and bacterial deterioration has been a major concern for many years. The rotting of wood by fungal and/or bacterial degradation is a particularly distressing problem, especially in relation to the use of wood for construction purposes and more especially with respect to the construction of homes.

Three classes of wood additives have proved to be the main rotproofing agents for wood for many years, i.e., creosote compounds, pentachlorophenol and arsenic compounds. While being relatively effective rotproofing additives, their use commercially has faded because they are all potential carcinogens. Not only are those treating the wood to render it rotproof exposed to these carcinogens, but in those cases where the treated wood is used in buildings, those humans or animals living in those buildings may also be in danger. Furthermore, since these additives are held in the wood by physical forces only, they oftimes migrate to the surface of the wood. Therefore, the inner portions of the wood are usually not durably treated—especially in the case of the use of creosote and/or pentachlorophenol.

In order to produce more durable rotproofing, wood has also been treated with phenol-formaldehyde precondensates or prepolymers which polymerize or cure to resinous products inside the wood. These products, however, also have disadvantages. They have a tendency to polymerize in solution before and during treatment, especially under conditions which catalyze the polymerization of the phenol-formaldehyde within the wood. When the molecule of precondensate or prepolymer is sufficiently large, it does not readily penetrate through the pores of the wood and especially will not penetrate into the core or heartwood. To alleviate this situation and to further improve the rotproofing characteristics, pentachlorophenol is oftimes added to the aqueous solution of phenol-formaldehyde resin former. Not only does this addition further the problem of the carcinogenicity because of the pentachlorophenol, but it adds to the cost of treating the wood because of the cost of the pentachlorophenol and the solvent for the pentachlorophenol which is necessary to make it miscible with the aqueous solution of phenol-formaldehyde precondensate. Also, since the pentachlorophenol does not react with the phenol-formaldehyde, it can leach out of the wood. U.S. Pat. No. 4,399,195 is directed to a composition of this type wherein the solvent is methanol, and over which this invention is an improvement.

Much of the rotproofing of wood today entails the use of pressure treatment of the wood to force the molecules, if they are small enough, into the core or heartwood. See, for example, U.S. Pat. No. 3,968,276, incorporated herein by reference. The pressure treatments are carried out in containers which are capable of being evacuated as well as pressurized. Oftimes the vessels containing the wood are first evacuated to remove air and moisture from the interior of the wood. With aqueous solutions of phenol-formaldehyde precondensate, green wood can be treated because some of the water can be removed, especially with cycles of evacuation to permit sufficient phenol-formaldehyde resin solids to be forced into the wood by the pressure treatment following the vacuum treatment.

The vacuum step may be carried out under various pressures for various time periods. Normally, vacuum of at least 10 inches of mercury and up to 30 inches of mercury or even more is used with time periods usually over 10 to 15 minutes and for longer periods of time especially if green wood is being treated. After evacuation the treating solution is added and then pressure applied. The pressure and time of treatment also can be varied. Normally, at least 100 psi is used and can be increased to as high as 300 psi or even higher. Times of pressure can vary from one to two minutes up to several hours.

The use of formaldehyde, urea-formaldehyde resins, melamine-formaldehyde resins, and resins of formaldehyde and various unsubstituted phenols and chlorinated phenols as rotproofing agents for regenerated cellulose, i.e., viscose rayon, is taught by Bell et al; J. Soc. Dyers & Colourists 71, November 1955; pages 660–667. Similar treatments of cotton are shown by Chance et al; Textile Research Journal, July 1959; pages 558–564.

Cotton and viscose rayon, however, while both being cellulosic in nature, are materially different than wood with regard to the size of specimen being treated and the difficulty most additives have in penetrating into the deepest portions of the wood. The Bell et al article teaches the use of many prepolymers which are converted into resins once present in the substrate. Although reaction of the prepolymer, i.e., monomer, with the cellulose is postulated, reaction of the prepolymer to form a resin still requires the availability of the reactive methylol groups capable of forming such a resin. Polymerization of phenol-formaldehyde prepolymers occurs either between available methylol groups on two different prepolymer molecules or between a methylol group and a hydrogen group of two different prepolymer molecules. In both instances, methylol groups available for reaction with a reactive hydroxy group of cellulose are taken up in the resin formation. Thus, reduction in the permanency of the resin positioning within the wood may occur. Bell et al further indicate that chlorinated phenols, however, fail to form resins when added to rayon as prepolymers.

Chance et al show the use of phenol, hydroxybenzyl alcohol, chlorinated phenols, brominated phenols, and fluorinated phenols as additives to cotton wherein again a resin is subsequently formed, and as such, the products resulting therefrom suffer from the same deficiencies as discussed above regarding viscose rayon. Chance, in fact, indicates that resin penetration into the cellulosic fiber is very poor, i.e., only a surface treatment is achieved.

DESCRIPTION OF THE INVENTION INCLUDING PREFERRED EMBODIMENTS

The present invention provides a method for the rotproofing of wood with a small moleculed rotproofing agent in an alkaline, aqueous solution wherein the rotproofing agent penetrates deep into the heartwood. The alkalinity of the treating solution not only opens up the pores of the wood but is a catalyst for the chemical reaction of the agent with the wood. Thus, the rotproofing agent not only penetrates into the heartwood but covalently reacts with the wood and is durably held in the wood.

The method of the present invention comprises treating the wood to render it less susceptible to fungal and/or bacterial deterioration, under conditions such as to cause substantially complete impregnation of the wood, such as those pressure treatments described above, with an aqueous, alkaline solution of a compound having the formula

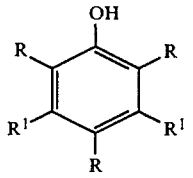

(I)

wherein each R is a blocking group, for example, each R is, individually, a halogen, alkyl ($C_1$ or $C_2$), hydroxy, nitro, nitroso, or alkylol ($C_1$ or $C_2$) group, with the proviso, however, that at least one R group is an alkylol group, and each $R^1$ is, individually, hydrogen or R, and recovering the resultant treated wood.

A preferred group of compounds falling within the scope of those of Formula I are the compounds wherein both $R^1$ groups are hydrogen, and at least one of the remaining R groups is a halogen.

An even more preferred class of compounds useful herein are those of Formula I wherein all the remaining R groups and $R^1$ groups are halogen.

From about 1% to about 20% by weight, based on the weight of the wood being treated, has been found to reduce successfully the rotting of the wood, the higher concentrations providing the greatest degree of rotproofing.

Examples of compounds falling within the scope of those of Formula I include 2,4,6-trimethylol phenol; 2-chloro-4,6-dimethylol phenol; 2,4-dichloro-6-methylol phenol; 4-chloro-2,6-dimethylol phenol; 2,4,6-triethylol phenol; 2-chloro-4,6-diethylol phenol; 2-nitro-4,6-dimethylol phenol; 2-hydroxy-4,6-dimethylol phenol; 3,4,5-trichloro-2,6-dimethylol phenol; 2,3,5,6-tetrachloro-4-methylol phenol; and the like. Compounds wherein the chlorine derivatives are replaced by their corresponding bromine, fluorine, or iodine derivatives, may also be used.

The compounds of Formula I are well known in the art and may be prepared by any known method. One method comprises reaction of the appropriately substituted phenol compound with formaldehyde or other alkyl aldehyde of up to two carbon atoms to replace a hydrogen with an alkylol group.

After the alkylolated phenol has been impregnated into the deepest recesses of the wood, the wood may be heated to a temperature ranging from about 80°–250° F. from about 30 minutes to 30 days in order to enhance the rotproofing, the time and temperature depending on the species of wood.

While not wishing to be bound by any particular theory with regard to how or why the process of the present invention imparts rot-resistance to wood, it is thought that because resin formation is depressed under the conditions of application because the active positions of the phenol compounds, i.e., the 2, 4, and 6 positions, which usually contain a reactive hydrogen are blocked by the R substituents under the alkaline conditions, the molecule is allowed to remain small and is therefore capable of penetrating deeper into the pores of the wood, especially the heartwood, and at least one alkylol group of the compound, in the meantime, reacts with the available hydroxy groups of the cellulose and hemicellulose of the wood. As a result, the cellulosic hydroxyl groups are no longer susceptible to attack by the enzymes of fungi. Rotting is therefore decreased.

Normal polymerization of phenol-formaldehyde occurs with a methylol group (in the 2, 4, or 6 positions) on one phenol molecule reacting with a hydrogen in the 2, 4, or 6 positions of another phenol molecule splitting off water. Under acid conditions, a methylol group of one phenol may react with a methylol group in another phenol molecule, again splitting off water and forming an ether group. Under alkaline conditions, however, this reaction between methylol groups is not favored. Instead a methylol group on one phenol molecule reacts with a hydrogen in the 2, 4, or 6 positions of another phenol molecule. These reactions continue if enough formaldehyde is available to form 2,4,6-trimethylol phenol. With this invention, however, blockage of the hydrogen groups in the 2, 4, and 6 positions prevents, or at least slows, the reaction of one phenol molecule with another to form a polymer or resin and permits instead the reaction of the methylol phenol with the hydroxy groups of the wood.

As mentioned above, the alkaline treatment of the present invention, i.e., at a pH of at least 7.1, also forms part of the unique results of this process because, as mentioned above, it swells the wood and further enhances penetration of the phenolic compound. It also provides a catalyst for the reaction between the alkylol groups of the additive and the hydroxy groups of the wood.

When the preferred compounds of the present invention are used, i.e., those containing a halogen group, the halogen groups provide fungicidal properties to the phenol molecule besides blocking the active hydrogen which normally actively participates in the formation of resinous products.

Mixtures of the compounds represented by Formula I may also be used herein and, in fact, may oftimes be preferred such as where a high degree of fungicidal activity and cellulose reaction is desired, i.e., a mixture of a monoalkylolated, polyhalogenated phenol and a polyalkylolated phenol. Oftimes, also commercial procedures for the manufacture of these phenols result in the formation of mixtures thereof.

If, in addition to rotproofing, fire resistance of the wood is desired, any number of known fire-retardant products may be added during the process of the present invention. The phosphates such as the ammonium phosphates, for example, can be used. However, these do not usually provide durable fire retardancy by themselves. If the reactive tetrakis(hydroxymethyl)phosphonium salts are used, however, durable fire retardancy as well as rotproofing can be obtained.

Furthermore, biocidal properties may be imparted to the wood by including in the alkylolated phenol solution such biocides as 1-[[2-(2,4-dichlorophenyl)-1,3-dioxolan-2-yl]methyl]-1H-1,2,4-triazole; chlorpyrifos-[O,O-diethyl O-(3,5,6-trichloro-2-pyridyl)phosphorothionate]; DOMINEX® pyrethroid-(C.A. number 67375-30-8). These biocides may be used as organic solvent solutions in such solvents as methanol, xylene, acetone, etc., usually in combination with an effective emulsifier.

Any type of wood can be treated in accordance with the process of the present invention, with such woods as Douglas-fir, cedar, larch, redwood, pine, spruce, maple, chestnut, oak, and the like being exemplary.

The following examples are set forth for purposes of illustration only and are not to be construed as limitations on the present invention except as set forth in the appended claims. All parts and percentages are by weight unless otherwise specified.

EXAMPLE 1

A piece of Douglas-fir plywood is rotproofed by exposing it to an alkaline, aqueous solution of 2-chloro-4,6-dimethylol phenol (pH 7.5) to deposit within the wood 10% solids of the 2-chloro-4,6-dimethylol phenol on the dry weight of the wood. The wood impregnated is a piece of ⅜ inch Douglas-fir plywood which is placed in a chamber and evacuated under a vacuum of 29 inches of mercury. The solution of 2-chloro 4,6-dimethylol phenol is drawn into the chamber to totally immerse the plywood. After 20 minutes of vacuum, pressure is built up to 100 psi and held for 2 minutes. The chamber then is drained, evacuated for 10 minutes, and the plywood removed and allowed to dry. The treated wood is found to be rotproofed.

EXAMPLE 2

A piece of green red oak, 1×5×30 inches with a moisture content of 28%, is placed in a chamber and impregnated with an alkaline, aqueous solution of 2,4-dichloro-6-methylol phenol (pH 8.0) to deposit 7.5% solids of the 2,4-dichloro-6-methylol phenol on the weight of the dry wood. A vacuum of 29 inches of mercury is applied to the wood in the chamber for 15 minutes. The impregnating solution is then admitted to the chamber to cover the sample of wood and the vacuum maintained for 20 minutes. Pressure is built up in the chamber to 300 psi and the pump secured until the pressure falls to 200 psi. The pressure is then increased again to 300 psi. This cycle is repeated five times. The solution is then drained and the wood removed and dried at room temperature for 72 hours. The wood is found to be rotproofed.

EXAMPLE 3

A green Douglas-fir 12×12-inch timber, 2 feet long, is placed in a chamber and the chamber evacuated to 26 inches of mercury. An alkaline, aqueous solution of 4-chloro-2,6-dimethylol phenol (pH 7.1) is drawn into the chamber until the timber is totally immersed. Vacuum is increased to 29 inches of mercury and held for 15 minutes. The chamber is vented to the atmosphere, closed, and vacuum again applied. The solution is again drawn into the chamber until 20% solids of the phenol is deposited on the weight of the wood. Pressure is then increased to 300 psi and held for 15 minutes. The chamber is then drained and the wood removed. The wood is then exposed to a temperature of 250° F. for one hour to effect further reaction of the halogenated methylol phenol with the wood. Rotproofing is again effected.

EXAMPLE 4

A piece of red oak (1×5×30 inches) is placed in a chamber and impregnated with an alkaline, aqueous solution (pH 7.6) of 2-chloro-4,6-dimethylol phenol and tetrakis(hydroxymethyl)phosphonium sulphate to deposit within the wood 10% solids of the 2-chloro-4,6-dimethylol phenol and 15% solids of the tetrakis(hydroxymethyl)phosphonium sulphate on the dry weight of the wood by evacuation of the chamber with a vacuum at 29 inches of mercury for 10 minutes and then immersion of the wood in the treating solution. After 20 minutes of vacuum, the pressure is built up to 100 psi and held for 5 minutes. The chamber is then drained and the wood heated for 20 minutes at 250° F. The resultant wood is found to be rotproofed and flame resistant.

EXAMPLE 5

A ⅜-inch Douglas-fir plywood sample is rotproofed by exposing it to an alkaline solution of 2,4,6-trimethylol phenol (pH 7.4) to deposit within the wood 8% solids of the rotproofing agent. The wood is placed in a chamber which is then evacuated to 28 inches of mercury. The alkaline solution is drawn into the chamber to immerse the wood. After 15 minutes of vacuum, the pressure is built up to 120 psi and held for 5 minutes. After the chamber is drained, the plywood is heated for 2 hours at 200° F. The plywood is found to be rotproofed.

EXAMPLE 6

A piece of red oak (1×6×36 inches) is placed in a chamber and impregnated with an alkaline solution of 2,4-dimethyl-6-methylol phenol (pH 8.1) to deposit within the wood 9% solids of the impregnating material. The wood is first placed in a chamber and evacuated with a vacuum of 29 inches of mercury for 8 minutes and then immersed in the treating solution. After 15 minutes of vacuum, the pressure is built up to 100 psi and held for 10 minutes. The chamber is then drained, the wood removed and dried. The wood is rotproofed.

EXAMPLE 7

The procedure of Example 1 is again followed except that the phenolic compound is 2-chloro-4,6-diethylol phenol. Similar results are obtained.

EXAMPLES 8–12

Again following the procedure of Example 1, various compounds falling within the scope of those of Formula I, above, are impregnated into the fir plywood. In each instance, rotproofing of the plywood occurs. The specific compounds employed are listed in Table I, below.

TABLE I

| Example | Compound of Formula I |
|---|---|
| 8 | 2-hydroxy-4,6-dimethylol phenol |
| 9 | 3,5-dichloro-2,4,6-trimethylol phenol |
| 10* | 2,6-dinitro-4-methylol phenol |
| 11 | 3,5-dibromo-4,6-dimethyl-2-methylol phenol |
| 12** | 3,4,5,6-tetrachloro-2-methylol phenol |

*Example 4 followed in lieu of Example 1.
**The treated wood is heated at 100° F. for 30 days.

EXAMPLE 13

Example 1 is again followed in all material detail except that a mixture of 2-chloro-4,6-dimethylol phenol and 2,4-dichloro-6-methylol phenol (50/50) is employed. Similar results are achieved.

EXAMPLE 14

Again following the procedure of Example 2 except that the aqueous solution also contains 0.5% of 1-[[2-(2,4-dichlorophenyl)-1,3-dioxolan-2-yl]methyl]-1H-1,2,4-triazole. The resultant wood exhibits fungicidal properties in addition to being rot-proofed.

EXAMPLE 15

The procedure of Example 14 is followed except that the insecticide employed is chlorpyrifos[O,O-diethyl O-(3,5,6-trichloro-2-pyridyl)phosphorothionate]. Again, excellent results are achieved.

I claim:

1. A method of treating wood to render it less susceptible to fungal and bacterial deterioration comprising contacting said wood, under conditions such as to cause substantially complete impregnation of the wood, with an aqueous, alkaline solution of a compound having the formula

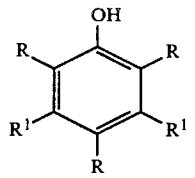

wherein each R is a blocking group with the proviso that at least one R group is an alkylol group, and Each $R^1$, individually, is hydrogen or R, and recovering the resultant treated wood.

2. A method according to claim 1 wherein each R is, individually, a halogen, alkyl ($C_1$ or $C_2$), hydroxy, nitro, nitroso, or alkylol ($C_1$ or $C_2$) group.

3. A method according to claim 1 wherein each $R^1$ group is hydrogen and each R group is an alkylol.

4. A method according to claim 2 wherein each R group is methylol.

5. A method according to claim 1 wherein each $R^1$ group is hydrogen, and two R groups are chlorine.

6. A method according to claim 1 wherein each $R^1$ group is hydrogen, two R groups are methylol, and the remaining R group is chlorine.

7. A method according to claim 1 wherein both $R^1$ groups are chlorine, one R group is chlorine, and the remaining R groups are methylol.

8. A method according to claim 1 wherein both $R^1$ groups are hydrogen and one R group is methyl.

9. A method according to claim 8 wherein one of the remaining R groups is chlorine.

10. A method according to claim 1 wherein both $R^1$ groups are hydrogen and two R groups are methyl.

11. A method according to claim 1 wherein the wood is contacted with said compound under pressure.

12. A method according to claim 1 wherein said aqueous, alkaline solution also contains a flame-retarding agent.

13. A method according to claim 12 wherein said flame-retarding agent is tetrakis(hydroxymethyl)phosphonium sulfate.

14. A product comprising wood treated in accordance with the method of claim 1.

15. A product comprising wood treated in accordance with the process of claim 2.

16. A method according to claim 1 wherein the aqueous solution also contains a biocide.

* * * * *